US007643023B2

(12) United States Patent
Naito et al.

(10) Patent No.: US 7,643,023 B2
(45) Date of Patent: Jan. 5, 2010

(54) MATRIX TYPE DISPLAY DEVICE AND DISPLAY METHOD THEREOF

(75) Inventors: Masahiro Naito, Tokyo (JP); Hidehiko Nakatani, Tokyo (JP); Naoto Sugawara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1031 days.

(21) Appl. No.: 10/546,539

(22) PCT Filed: Feb. 19, 2004

(86) PCT No.: PCT/JP2004/001874

§ 371 (c)(1),
(2), (4) Date: Aug. 22, 2005

(87) PCT Pub. No.: WO2004/077393

PCT Pub. Date: Sep. 10, 2004

(65) Prior Publication Data

US 2006/0139359 A1 Jun. 29, 2006

(30) Foreign Application Priority Data

Feb. 25, 2003 (JP) ..... 2003-047054

(51) Int. Cl.
*G09G 5/00* (2006.01)

(52) U.S. Cl. ..... 345/213; 345/214

(58) Field of Classification Search ..... 345/213, 345/214

See application file for complete search history.

(56) References Cited

U.S. PATENT DOCUMENTS 4,727,363 A 2/1988 Ishii
6,700,571 B2 * 3/2004 Nakatani et al. ..... 345/213
7,330,179 B2 * 2/2008 Endo et al. ..... 345/204
2002/0047847 A1 4/2002 Tamura
2002/0190943 A1 12/2002 Kayada et al.

FOREIGN PATENT DOCUMENTS

JP 59-52290 A 3/1984

(Continued)

OTHER PUBLICATIONS

Inter net site http://ascii24.com/news/columns/10100/article/1998/08/31/print/621078/html. pp. 1-5.

*Primary Examiner*—Kevin M Nguyen
(74) *Attorney, Agent, or Firm*—Birch, Stewart, Kolasch & Birch, LLP

(57) ABSTRACT

In the case where graphic data GD1 needing a high-speed rendering are to be written in a frame memory (14) from an image writing unit (1), the graphic data GD1 are written in the frame memory (14) in accordance with an instruction from the image writing unit (1) irrespective of the read state of graphic data GD2 to be read from the frame memory (14). In the case of the graphic data GD1 needing an ordinary speed, on the other hand, a write wait signal WT is outputted from a data write control unit (2) to the image writing unit (1) for the period till the read of the graphic data GD2 from the frame memory (14) ends. For the period while the write wait signal WT is being outputted, the write of the graphic data GD1 from the graphic data writing unit (1) is made to wait.

13 Claims, 10 Drawing Sheets

FOREIGN PATENT DOCUMENTS

| | | | |
|---|---|---|---|
| JP | 59-52291 | A | 3/1984 |
| JP | 59-52292 | A | 3/1984 |
| JP | 60-254225 | A | 12/1985 |
| JP | 3-1191 | A | 1/1991 |
| JP | 2002-108268 | A | 4/2002 |
| JP | 2002-108316 | A | 4/2002 |
| JP | 2002-202881 | A | 7/2002 |
| JP | 2002-251370 | A | 9/2002 |
| JP | 2003-5948 | A | 1/2003 |
| JP | 2003-122335 | A | 4/2003 |

* cited by examiner

MATRIX TYPE DISPLAY DEVICE AND DISPLAY METHOD THEREOF

TECHNICAL FIELD

The present invention relates to a matrix type display device for displaying an image using a display panel such as a matrix type liquid crystal panel or a matrix type fluorescent display panel having pixel portions at intersections arrayed in a matrix shape and, more particularly, to a matrix type display device to be used in a display unit of a mobile information terminal device such as a mobile telephone device for displaying an image of a high frame rate such as motion images or graphic images, and to a display method for the device.

BACKGROUND ART

The matrix type display device of the prior art stores graphic data, as inputted from image writing means such as CPU, temporarily in a built-in frame memory when the graphic data are to be displayed in a predetermined display panel.

Here, when the graphic data are read from the frame memory and outputted to the display panel, graphic data inputted from the outside may be overwritten midway of one frame thereof. Then, there may occur an event, in which the contents of the image of upper and lower portions of one frame are shifted with time, when the motion images or still images are displayed.

In order to prevent that shift of the image contents, in the frame memory, as conventionally described in the following Patent Publications, a write wait signal is outputted from the side of the matrix type display device to the side of the external image writing means, and the input of the graphic data to the matrix type display device is delayed until the end of reading the each frame of the graphic data. Thus, the write of the image in the frame memory is brought into the stop state thereby to control the synchronization properly between the write and read of the graphic data, so that the graphic data inputted from the outside may not be overwritten midway of the graphic data of one frame outputted to the display panel:

JP-A-2002-108268;

JP-A-2002-108316; and

JP-A-2002-202881.

As a result, when the motion images or the still images are displayed, it is possible to prevent the event, in which the image contents of the upper and lower portions in one frame are shifted with time, and accordingly to display a smooth image.

DISCLOSURE OF THE INVENTION

In the matrix type display device of the prior art, when the graphic data from the image writing means such as the external CPU are to be written, the write of a next image is delayed till the end of the read of the image from the frame memory.

Therefore, even in the case where an application needing a high-speed rendering such as the Java (i.e., the registered trade name) is started to render the image, the write of the graphic data is delayed to raise a problem that the rendering speed is retarded.

As a matter of fact, according to the kind of the application, the rendering speed is 70 frames/sec. or higher. In the case of synchronization with the read of the display module, therefore, the image cannot be updated other than the refresh cycle of the display module such as the speed of about 60 frames/sec. This raises a problem that the rendering speed is retarded by the write wait.

Therefore, an object of this invention is to provide a matrix type display device capable of preventing the rendering speed and the processing ability in the image write from lowering, and a display method for the display device.

In order to solve the problems thus far described, according to this invention, there is provided a matrix type display device comprising: a frame memory capable of storing at least one frame of graphic data inputted from an image writing unit; a data write control circuit for outputting a write wait signal for causing the write of graphic data to the frame memory to wait, to the image writing unit, and for outputting a write end signal at the time of ending the write of the graphic data inputted from the image writing unit for each frame, in the frame memory; a synchronizing circuit for outputting a read start signal on the basis of the write end signal and a frame synchronizing signal; a data read control circuit for reading the graphic data stored in the frame memory, on the basis of the read start signal; an in-module frame memory for storing the graphic data read from the frame memory; and a display drive circuit for outputting the frame synchronizing signal, reading the graphic data stored in the in-module frame memory and for driving a display panel for displaying the graphic data.

BEST MODE FOR CARRYING OUT THE INVENTION

The present invention is described in the following in connection with its shown embodiments.

FIRST EMBODIMENT

<Configuration>

Figure 1:
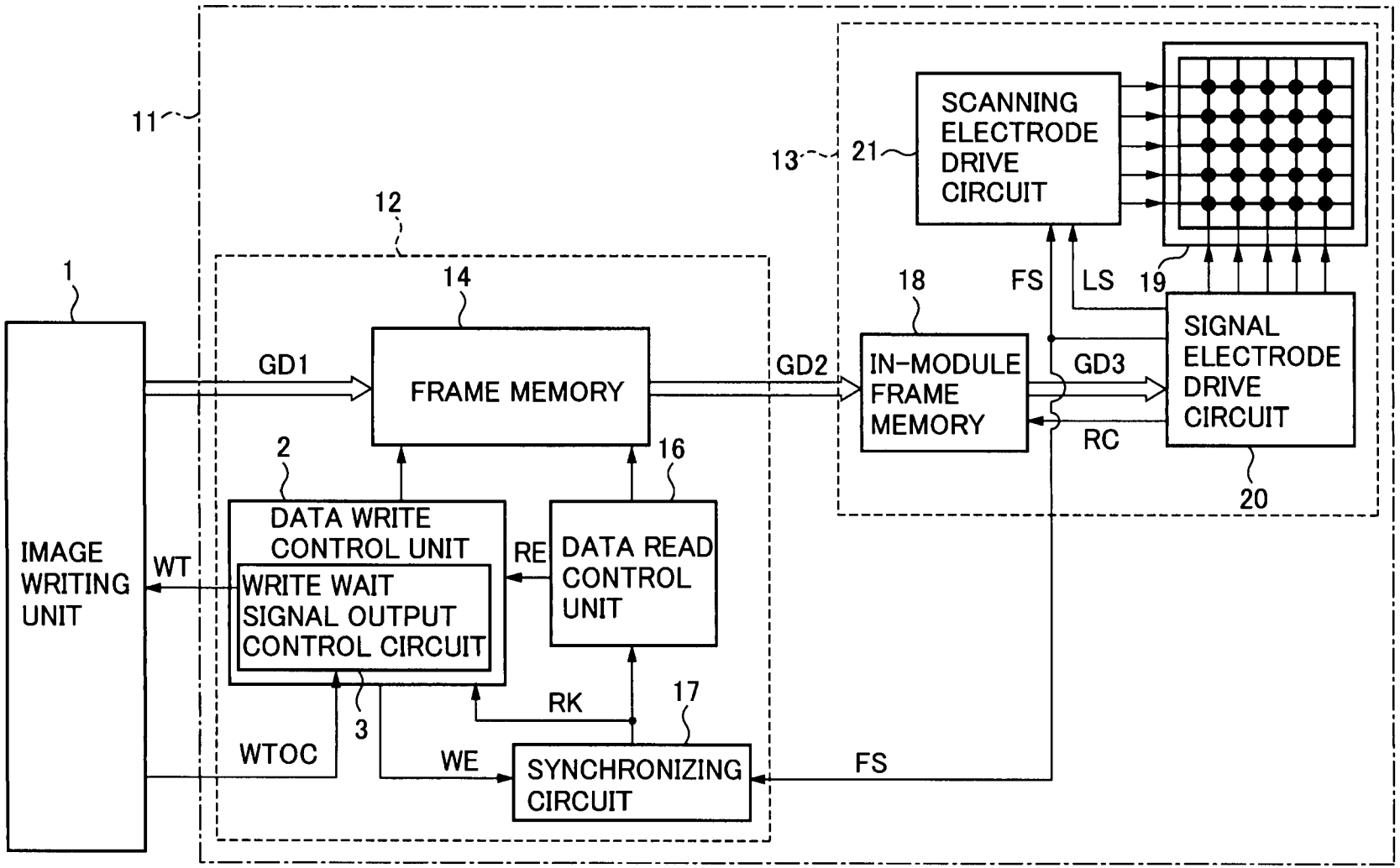
FIG. 1 is a block diagram showing a matrix type display device according to Embodiment 1 of this invention.

FIG. 1 is a block diagram showing a matrix type display device 11 according to Embodiment 1 of this invention. This matrix type display device 11 receives inputs of graphic data of motion images or still images produced in an image writing unit (i.e., an external supplier of graphic data) 1 having a CPU or the like, as shown in FIG. 1, and displays those graphic data. The matrix type display device 11 is provided with an input control unit 12 for controlling the timings or the like of the graphic data inputted, and a display panel module unit 13 for displaying the inputted graphic data.

The image writing unit 1 is enabled to transmit a WT output control signal (or an output control signal) WTOC to the later-described write wait signal output control circuit 3 in the input control unit 12. This WT output control signal WTOC is one for deciding whether or not the transmission of a write wait signal WT from the input control unit 12 is permitted. In the case where it is desired to display such images (e.g., the motion images) needing a high-speed rendering using applications such as the java (i.e., the registered trade name) the WT output control signal WTOC is outputted at a low level so that the write wait signal WT may not be outputted from the write wait signal output control circuit 3. In the case the where high-speed rendering for displaying still images or the like is not needed, the WT output control signal WTOC is outputted at a high level so that the output of the write wait signal WT from the write wait signal output control circuit 3 may be permitted.

The input control unit 12 is configured to include: a frame memory 14 for storing input graphic data temporarily at least at a frame unit; and a circuit unit having a microprocessor, an address bus, a data bus, a control line and so on. Moreover, the circuit unit having the microprocessor is provided, as its components for functioning according to a software program, with: a data write control unit 2 for controlling the write of graphic data GD1 in the frame memory 14; a data read control unit 16 for controlling the read of graphic data GD2 from the frame memory 14; and synchronizing circuit 17 for controlling the synchronization between the data write control unit 2 and the data read control unit 16.

The data write control unit 2 is provided with: a function to make a control to start the write of the graphic data GD1 fed from the image writing unit 1, in the frame memory 14 at the instant when a (later-described) read end signal RE is given from the data read control unit 16; and a function to output a write end signal WE to the synchronizing circuit 17 at the instant when the write of the graphic data GD1 in the frame memory 14 ends.

This data write control unit 2 is further provided therein with the write wait signal output control circuit 3 for outputting the write wait signal WT suitably to the external image writing unit 1.

This write wait signal output control circuit 3 outputs the write wait signal WT to the image writing unit 1 so that the image of the next frame may not be written in the frame memory 14 till the graphic data written in the frame memory 14 are transferred to the display panel module unit 13 (i.e. , a later-described in-module frame memory 18). As a result, the data write control unit 2 can cause the start of the write of the next frame to wait till the instant when the read end signal RE from the data read control unit 16 is inputted.

The write wait signal output control circuit 3 has a function to switch the write wait signal WT to be outputted to the image writing unit 1 according to the WT output control signal WTOC fed from the image writing unit 1. Specifically, the case, in which the WT output control signal WTOC is the low output, means that the output of the write wait signal WT to the image writing unit 1 is inhibited. From now on, therefore, the output of the write wait signal WT to the image writing unit 1 is stopped till the WT output control signal WTOC at the high output is fed. On the contrary, the case, in which the WT output control signal WTOC is the high output, means that the output of the write wait signal WT to the image writing unit 1 is permitted. From now on, therefore, the output of the write wait signal WT to the image writing unit 1 is suitably executed till the WT output control signal WTOC at the low output is fed.

The data read control unit 16 reads and transfers the graphic data stored temporarily in the frame memory 14, to the display panel module unit 13, and outputs the read end signal RE indicating the end of the read, to the data write control unit 2.

The synchronizing circuit 17 receives the inputs of a frame synchronizing signal FS from the display panel module unit 13 and the write end signal WE from the data write control unit 2, and outputs a read start signal RK to the data read control unit 16 in synchronism with the frame synchronizing signal FS.

The display panel module unit 13 is provided with: the in-module frame memory 18 for storing the graphic data temporarily for each frame; a display panel 19 for displaying the image; and a signal electrode drive circuit 20 and a scanning electrode drive circuit 21 for driving the display of the display panel 19.

Of these, the signal electrode drive circuit 20 makes and outputs a read control signal RC for reading the stored contents of the in-module frame memory 18 from the signal electrode drive circuit 20, to the in-module frame memory 18. And, the signal electrode drive circuit 20 makes and outputs the frame synchronizing signal FS to the scanning electrode drive circuit 21 and the synchronizing circuit 17, and makes and outputs a line synchronizing signal LS to the scanning electrode drive circuit 21.

On the basis of the frame synchronizing signal FS and the line synchronizing signal LS, on the other hand, the scanning electrode drive circuit 21 makes and outputs a control signal to the scanning electrodes of the display panel 19.

Here, the signal electrode drive circuit 20 and the scanning electrode drive circuit 21 function as a display drive circuit for driving the display of the display panel 19.

<Actions>

The actions of the matrix type display device 11 are explained in the following.

The image writing unit 1 decides whether the WT output control signal WTOC is to be made at the high output or at the low output according to the kind of application employed. Specifically, in the case of a display of still image needing no high-speed rendering, the image writing unit 1 sets the WT output control signal WTOC at the high output so as to permit the output of the write wait signal WT from the write wait signal output control circuit 3. On the contrary, in the case where images (e.g., motion images) needing the high-speed rendering as in the case of using the Java (i.e., the registered trade name) or an application for displaying an image inputted from a camera, the image writing unit 1 outputs the WT output control signal WTOC at the low level so as to inhibit the write wait signal WT from the write wait signal output control circuit 3.

Figure 2:
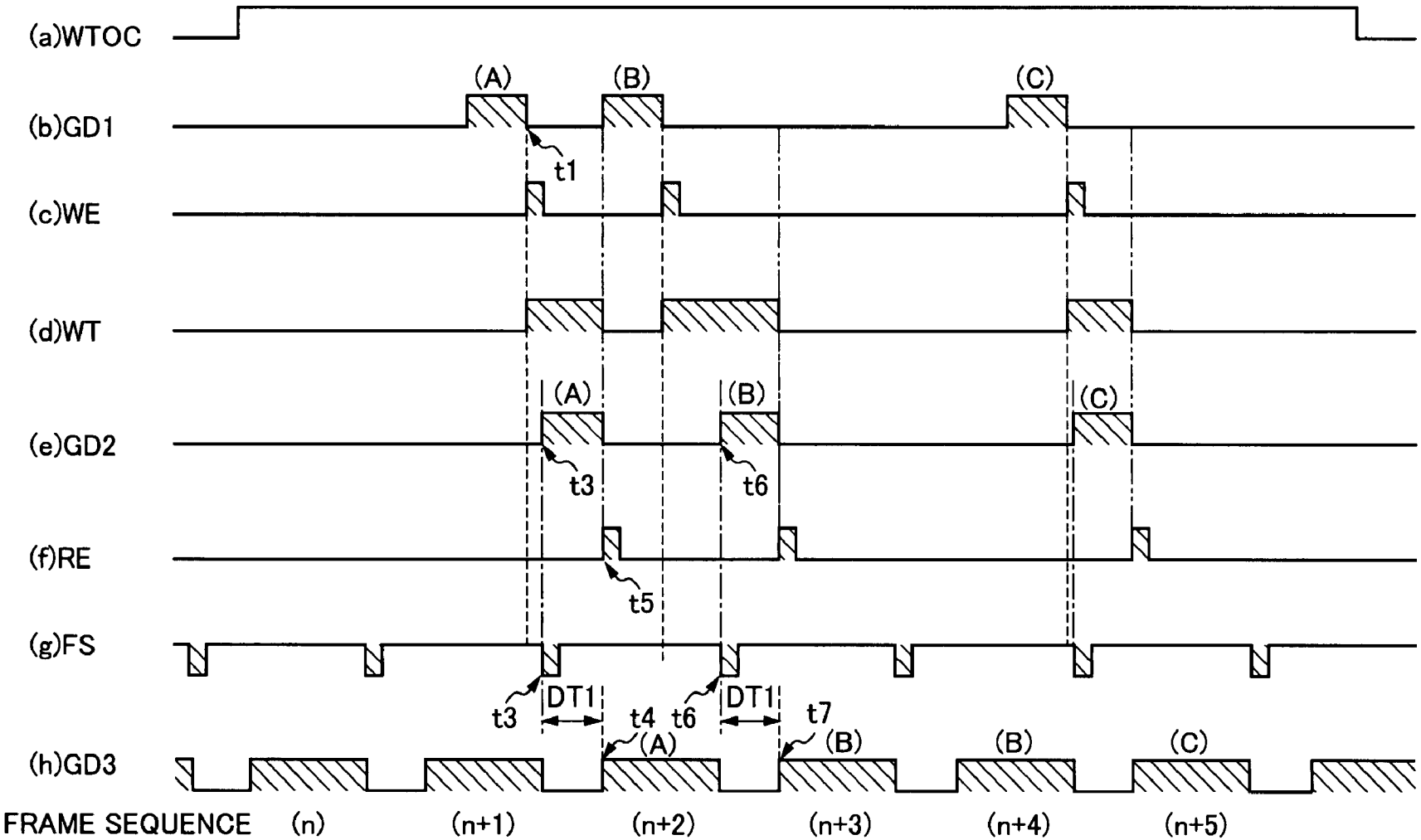
FIG. 2 is a timing chart illustrating the actions of the matrix type display device according to Embodiment 1 of this invention.

With reference to the timing chart of FIG. 2, here are described at first the actions of the matrix type display device 11 of the case, in which a still image or others images needing no high-speed rendering is displayed. Here: FIG. 2(*a*) illustrates the WT output control signal WTOC for deciding the permission or inhibition of the output of the write wait signal WT to be inputted from the external image writing unit 1 to the write wait signal output control circuit 3; FIG. 2(*b*) illustrates the graphic data GD1 to be inputted from the image writing unit 1 and written in the frame memory 14; FIG. 2(*c*) illustrates the write end signal WE fed from the data write control unit 2 to the synchronizing circuit 17; FIG. 2(*d*) illustrates the write wait signal WT to be outputted from the data write control unit 2 to the outside; FIG. 2 (*e*) illustrates the graphic data GD2 to be read from the frame memory 14 of the input control unit 12 and transferred to the in-module frame memory 18 of the display panel module unit 13; FIG. 2(*f*) illustrates the read end signal RE to be fed from the data read control unit 16 to the data write control unit 2; FIG. 2(*g*) illustrates the frame synchronizing signal FS to be fed from the signal electrode drive circuit 20 to the scanning electrode drive circuit 21 and the synchronizing circuit 17; and FIG. 2(*h*) illustrates graphic data GD3 to be read from the in-module frame memory 18 and inputted to the signal electrode drive circuit 20.

At first, in the case of the display of the still image needing no high-speed rendering, the image writing unit 1 outputs the WT output control signal WTOC at the high level, as illustrated in FIG. 2(*a*), so as to permit the output of the write wait signal WT from the write wait signal output control circuit 3. Since the WT output control signal WTOC from the image writing unit 1 is the high output in this case, the write wait signal output control circuit 3 decides that the output of the write wait signal WT is permitted.

When graphic data (A) are inputted as the GD1 from the external image writing unit 1 to the matrix type display device 11, as shown in FIG. 1, the graphic data GD1 are controlled by the data write control unit 2 and are once stored in the frame memory 14.

When the storage of the graphic data GD1 in the frame memory 14 ends at a timing t1, as illustrated in FIG. 2(*b*), the write end signal WE is outputted at the timing t1 from the data write control unit 2 to the synchronizing circuit 17 as illustrated in FIG. 2(*c*).

Since the WT output control signal WTOC from the image writing unit 1 is the high output, the write wait signal output control circuit 3 of the data write control unit 2 decides that the write wait signal WT is permitted, and outputs the write wait signal WT at the timing t1 to the image writing unit 1, as illustrated in FIG. 2(*d*), so that graphic data (B) of the next frame may not be written in the frame memory 14.

The synchronizing circuit 17 is reset into a wait state, at the instant when it is fed with the write end signal WE from the data write control unit 2, and waits till the frame synchronizing signal FS, as illustrated in FIG. 2(*g*), is inputted at first.

On the basis of a reference signal produced by the not-shown oscillation circuit, the signal electrode drive circuit 20 in the display panel module unit 13 produces and outputs the read control signal RC to the in-module frame memory 18. And, the signal electrode drive circuit 20 outputs the frame synchronizing signal FS (of FIG. 2(*g*)) at a timing t3 to the scanning electrode drive circuit 21 and the synchronizing circuit 17, and produces and outputs the line synchronizing signal LS to the scanning electrode drive circuit 21.

On the basis of the frame synchronizing signal FS and the line synchronizing signal LS, the scanning electrode drive circuit 21 produces and outputs a control signal to the scanning electrodes of the display panel 19.

When the frame synchronizing signal FS (of FIG. 2(*g*)) is inputted to the synchronizing circuit 17, the read start signal RK is outputted to the data read control unit 16 in synchronism with the timing t3 of the input of the frame synchronizing signal FS. Specifically, at this timing t3, the data read control unit 16 reads the graphic data GD1 temporarily stored in the frame memory 14, and transfers the data as the graphic data GD2 (of FIG. 2 (*e*)) to the in-module frame memory 18. In FIG. 2(*d*) to FIG. 2(*g*), the next graphic data GD2 (of FIG. 2(*e*)) are transferred from the frame memory 14 to the in-module frame memory 18 on the basis of the instruction of the data read control unit 16 in synchronism with the output timing t3 of the frame synchronizing signal FS (of FIG. 2 (*g*)) for reading the (n+2)-th graphic data stored in the in-module frame memory 18.

On the other hand, the graphic data GD3 (of FIG. 2(*h*)) are outputted from the in-module frame memory 18 to the signal electrode drive circuit 20 at a timing t4, which is delayed by a delay time DT1 from the timing t3 of the frame synchronizing signal FS (of FIG. 2(*g*)).

At the instant when the (n+2)-th graphic data stored in the in-module frame memory 18 are to be read as GD3, therefore, the graphic data (A) newly transferred and stored are read as the GD3 so that they are not changed midway of one frame, while being read, to the graphic data newly transferred.

The next write data or the graphic data (B) are not written in the frame memory 14 for the time period (while the write wait signal WT is the high output) from the timing t1 of the write end signal WE of FIG. 2(*c*) to a timing t5, at which the read end signal RE of FIG. 2(*f*) is outputted.

When the read end signal RE (of FIG. 2(*f*)) is fed at the timing t5 from the data read control unit 16 to the data write control unit 2, the write wait signal WT (of FIG. 2(*d*)) is changed into the low output. As a result, the graphic data (B) (of FIG. 2(*b*)) of the next frame from the image writing unit 1 are written in the frame memory 14 at the instant of the timing t5.

Here, the graphic data GD2 (of FIG. 2(*e*)) are fed from the input control unit 12 to the display panel module unit 13 in synchronism with the timing t3 of the frame synchronizing signal FS. On the other hand, the (n+2)-th graphic data GD3 (of FIG. 2(*h*)) are read in synchronism with the timing t4, which is delayed by the DT1 from the timing t3. Since the timing t3 of the frame synchronizing signal FS (of FIG. 2(*g*)) precedes the timing t4, at which the output of the graphic data GD3 is started, by the DT1, the (n+1)-th graphic data GD3 of FIG. 2(*h*) are not changed midway of the graphic data (A) being transferred.

Moreover, the transfer of the graphic data (B) of the next frame, which have been written in the frame memory 14 at the timing t5, to the in-module frame memory 18 is started at a timing t6 of the next frame synchronizing signal FS, at which the graphic data (A) are read from the in-module frame memory 18.

The graphic data (B) written in the in-module frame memory 18 are read as the (n+3)-th graphic data GD3 (of FIG. 2(*h*)) in synchronism with a timing t7, which is delayed by the DT1 from the timing t6. Since the timing t6 of the frame synchronizing signal FS (of FIG. 2(*g*)) precedes the timing t7, at which the output of the graphic data GD3 is started, by the DT1, the graphic data GD3 of the (n+2)-th frame of FIG. 2(*h*) are not changed midway of the frame of the graphic data (B) being transferred.

Thus in the matrix type display device 11, the graphic data GD2 (of FIG. 2(*e*)) are transferred from the frame memory 14 to the in-module frame memory 18 in synchronism with the frame period of the display panel 19. Therefore, the transfer of the graphic data GD2 (of FIG. 2(*e*)) to the in-module frame memory 18 and the read of the graphic data GD3 (of FIG. 2(*h*)) from the in-module frame memory 18 to the signal electrode drive circuit 20 can be prevented from being made coincident in contrast with the identical address in the in-module frame memory 18. From this, the data transfer is controlled to prevent one frame of an image displayed from being changed into one of next one frame. Therefore, when motion images or graphic images are displayed, they can be displayed in smooth images, because it is possible to prevent the event, in which the image contents might otherwise be shifted with time between the upper portion and the lower portion of one frame.

Here are explained the actions of the matrix type display device 11 of the case needing the high-speed rendering as in the case of using the Java (i.e., the registered trade name) or others.

Figure 3:
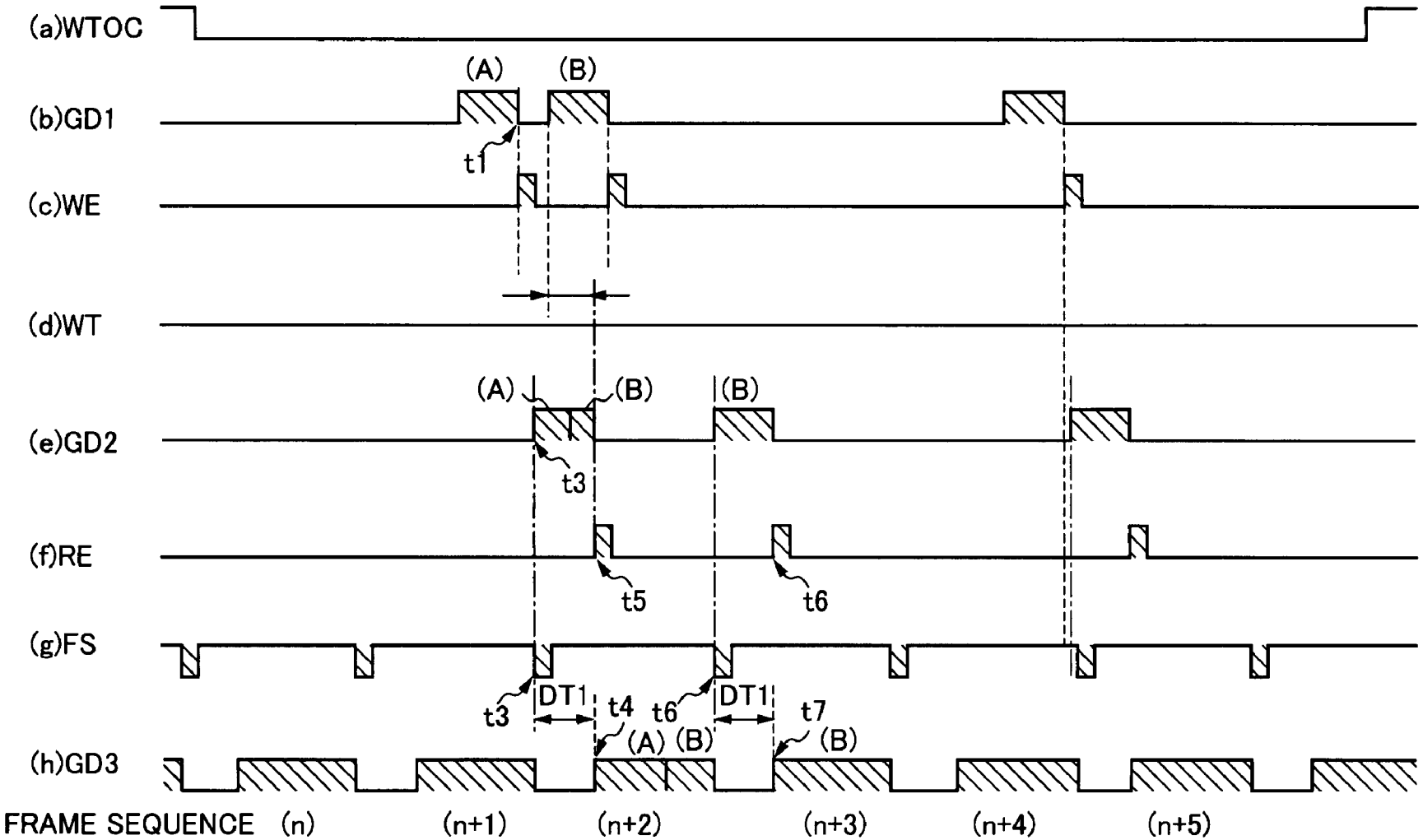
FIG. 3 is a timing chart illustrating the actions of the matrix type display device according to Embodiment 1 of this invention.

In the case where an application needing the high-speed rendering is started to render the image, the period of the graphic data GD1 may appear shorter than that of the waveform illustrated in FIG. 2(*b*), as illustrated in FIG. 3(*b*), so long as the write wait signal WT does not appear from the write wait signal output control circuit 3 of the data write control unit 2. If the write wait signal output control circuit 3 is permitted in this case to output the write wait signal WT, as described above, the write of the graphic data GD1 (of FIG. 2(*b*)) from the image writing unit 1 in the frame memory 14 is made to wait while the write wait signal WT (of FIG. 2(*d*)) is in the high state, thereby to raise a problem that the rendering speed is lowered. A rendering speed of 70 frames/sec. or higher may be needed for a kind of application. If this application is synchronized with the display module, which can n update the image only at a speed of about 60 frames/sec., a write wait occurs to delay the rendering speed.

Therefore, one example of the actions of the matrix type display device 11 in the display of the case needing the high-speed rendering is described with reference to the timing chart of FIG. 3. Here, the drawings of FIG. 3(*a*) to FIG. 3(*h*) correspond to those of FIG. 2(*a*) to FIG. 2(*h*), respectively. In FIG. 3, the image writing unit 1 outputs a low signal as the WT output control signal WTOC, as illustrated in FIG. 3(*a*), thereby to inhibit the output of the write wait signal WT from the write wait signal output control circuit 3. In this case, the write wait signal output control circuit 3 does not feed the image writing unit 1 with the write wait signal WT (that is, fixes the write wait signal WT always at the low output), because the WT output control signal WTOC from the image writing unit 1 is the low output.

Then, at the timing t1 illustrated in FIG. 3, the write wait signal WT is not outputted from the write wait signal output control circuit 3. Therefore, the write of the graphic data (B) in the frame memory 14 from the image writing unit 1 is started no matter whether or not the read of the graphic data (A) from the frame memory 14 might end.

In this case, as shown in FIG. 3(*e*), the graphic data (B) of a new frame may be updated midway of each frame in which the graphic data (A) is outputted as the graphic data GD2 to the display panel module 13 after it was once stored in the frame memory 14. In the graphic data GD2 to be written in the in-module frame memory 18, therefore, the image, which is cut midway by the graphic data (A) and the graphic data (B) contained, is stored so that the frame to be displayed as the (n+2)-th in the display panel module 13 contains the image, in which the graphic data (A) and the graphic data (B) are mixed and cut midway (FIG. 3(*h*)). However, the write of the graphic data in the matrix type display device 11 from the image writing unit 1 is not made to wait so that the execution speed of the application is not delayed.

Figure 4:
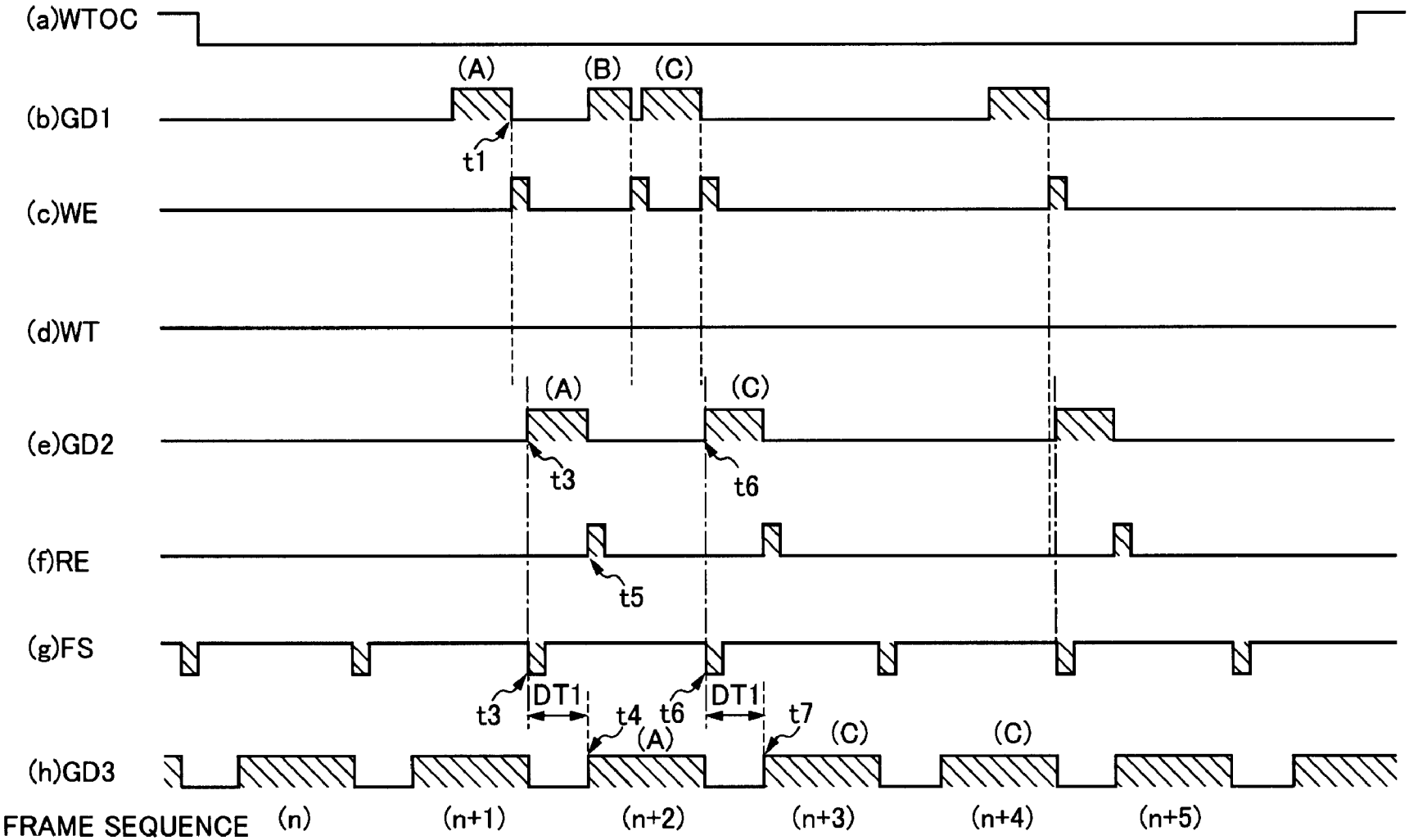
FIG. 4 is a timing chart illustrating the actions of the matrix type display device according to Embodiment 1 of this invention.

Moreover, another example of the actions of the matrix type display device 11 in the display of the case needing the high-speed rendering is described with reference to the timing chart of FIG. 4. Here, the drawings of FIG. 4(*a*) to FIG. 4(*h*) correspond to those of FIG. 3(*a*) to FIG. 3(*h*), respectively. In FIG. 4 as in FIG. 3, the image writing unit 1 outputs a low signal (FIG. 4(*a*)) as the WT output control signal WTOC, thereby to inhibit the output of the write wait signal WT from the write wait signal output control circuit 3. In this case, the write wait signal output control circuit 3 does not feed the image writing unit 1 with the write wait signal WT (that is, fixes the write wait signal WT always at the low output), because the WT output control signal WTOC from the image writing unit 1 is the low output.

Then, at the timing t1 illustrated in FIG. 4, the write wait signal WT is not outputted from the write wait signal output control circuit 3. Therefore, the write of the graphic data (B) in the frame memory 14 from the image writing unit 1 is started no matter whether or not the read of the graphic data (A) from the frame memory 14 might end.

In the case where the write timing of the graphic data (B) in the frame memory 14 from the image writing unit 1 is slower than the read end timing t5 of the graphic data (A), as shown in FIG. 4, the graphic data GD2 to be transferred from the frame memory 14 to the in-module frame memory 18 are the graphic data (A). Therefore, the image to be displayed in the display panel 19 does not become the midway cut image (FIG. 4(*h*)), in which the graphic data of different frames are mixed.

Moreover, at a timing later than the read end timing t5 of the graphic data (A), and after the timing t5 and before the timing t6 of the frame synchronizing signal FS inputted at first, the graphic data (B) and the graphic data (C) are written in the frame memory 14 (FIG. 4(*a*)). In this case, at the instant of the timing t6, the graphic data (C) are written over the graphic data (B) in the frame memory 14. As a result, the graphic data (C) are transferred as the graphic data GD2 from the frame memory 14 to the in-module frame memory 18 (FIG. 4(*e*)) so that the graphic data GD3 to be displayed on the display panel 19 are also the graphic data (C) (FIG. 4(*h*)). In short, the graphic data (B) are skipped and not displayed.

In the case where the write wait signal WT is thus fixed at the low output, an image may be displayed in a midway cut state, or some images may be skipped. However, the rendering can be made to match the frame speed of the graphic data GD1 fed from the image writing unit 1 so that the high-speed image can be rendered by the display panel module unit 13.

In the case where such an application is used that its own execution speed lowered as the rendering speed is lowered, for example, the rendering speed can match the application side thereby to prevent the processing delay on the application side. Moreover, the graphic data GD1 preferred to be rendered at the high speed can be displayed on the display panel module unit 13 at the frame speed fed from the image writing unit 1.

SECOND EMBODIMENT

<Configuration>

Figure 5:
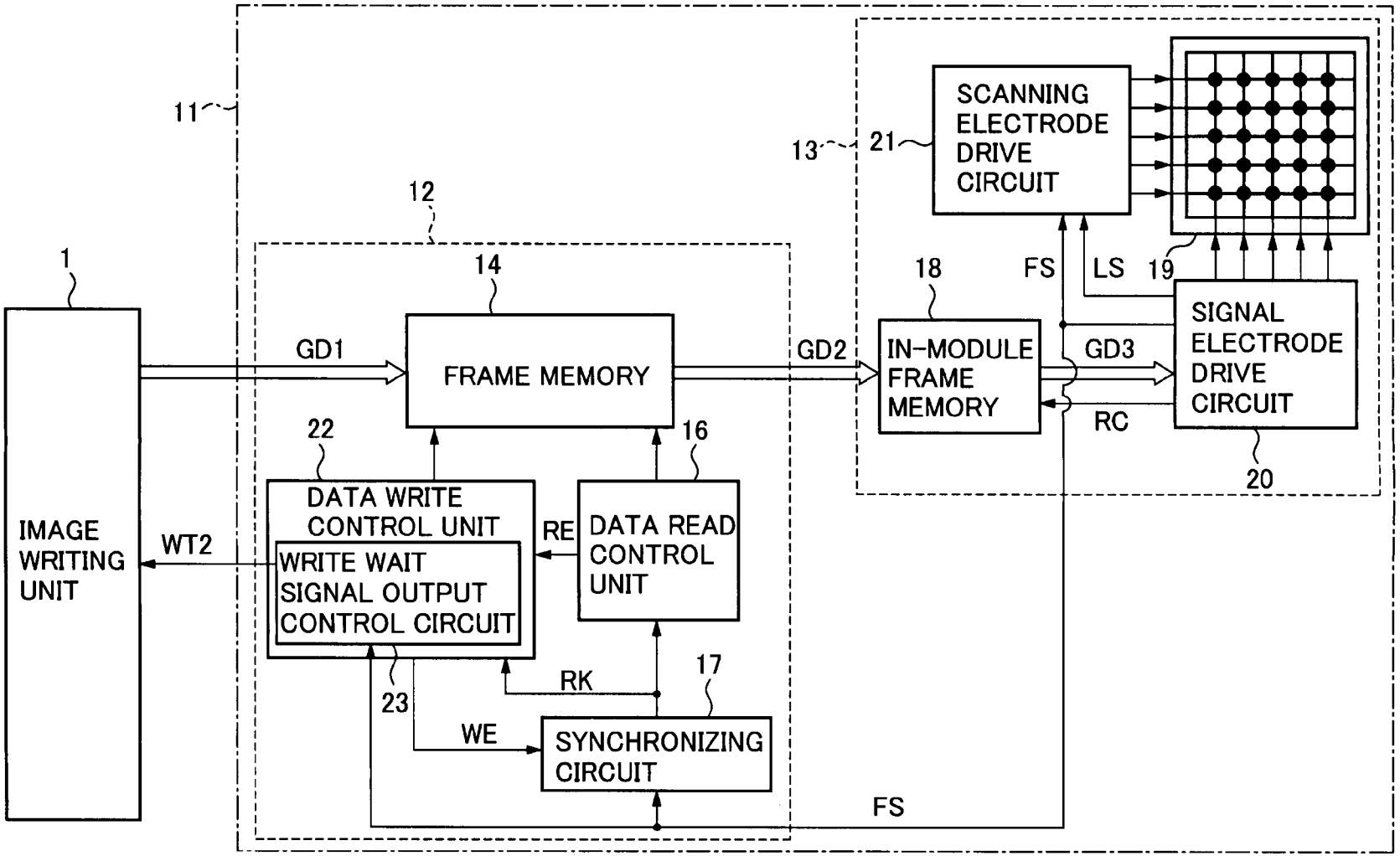
FIG. 5 is a block diagram showing a matrix type display device according to Embodiment 2 of this invention.

FIG. 5 is a block diagram showing a matrix type display device according to the second embodiment of this invention. Here in FIG. 5, the components having functions similar to those of the first embodiment are designated by the common reference numerals.

Here are described at first the points, at which the matrix type display device of this embodiment is different from the aforementioned first embodiment. This matrix type display device is configured, as shown in FIG. 5, such that the frame synchronizing signal FS outputted from the signal electrode drive circuit 20 is inputted to a write wait signal output control circuit 23 of a data write control unit 22. The write wait signal output control circuit 23 produces the write wait signal WT, which has been described in Embodiment 1 (although not shown in FIG. 5) in the case where the graphic data GD1 fed from the image writing unit 1 are written in the frame memory 14 in response to the frame synchronizing signal FS. However, the write wait signal WT is not outputted instantly to the outside from the inside of the write wait signal output control circuit 3 but converted in dependence on the high/low state of a write wait OFF flag WTOFF, as described later.

On the basis of the frame synchronizing signal FS, the write wait signal output control circuit 23 detects the write frequency of the graphic data GD1 from the image writing unit 1 in the frame memory 14 for a predetermined time period, and changes the write wait OFF flag WTOFF into the high state or the low state in the write wait signal output control circuit 3 in dependence upon whether or not the write frequency is high. Specifically, on the basis of the timing synchronized with the frame synchronizing signal FS, the write wait signal output control circuit 23 decides the number of productions of the write wait signal WT at all times. In the case where the number of productions is at a predetermined reference number m or more, the write wait signal output control circuit 23 decides that the write frequency of the graphic data GD1 is higher than the predetermined reference number, and sets the write wait OFF flag WTOFF into the high state. On the other hand, in the case where the number of productions of the write wait signal WT is the predetermined reference number m or less, the write wait signal output control circuit 23 decides that the write frequency is lower than the predetermined reference number, the write wait signal output control circuit 23 sets the write wait OFF flag WTOFF into the low state. Here, the detection of the predetermined reference number m may be referred to either one period or a predetermined plurality of periods of the frame synchronizing signal FS.

In the case where the write wait OFF flag WTOFF is in the low state, the write wait signal output control circuit 23 outputs the write wait signal WT at the high output as a second write wait signal WT2 at the high output to the image writing unit 1. In the case where the write wait OFF flag WTOFF is in the high state, the write wait signal output control circuit 23 outputs the second write wait signal WT2 at the low output even if the write wait signal WT becomes the high output.

In the case where the second write wait signal WT2 fed from the write wait signal output control circuit 23 is the low output, the image writing unit 1 transmits the graphic data GD1 of the next frame to the frame memory 14, and writes them. On the other hand, in the case where the second write wait signal WT2 is the high output, the image writing unit 1 stops the output of the graphic data GD1 of the next frame to the frame memory 14. Therefore, in the case where the write wait OFF flag WTOFF is in the high state in the write wait signal output control circuit 23, the second write wait signal WT2 is always the low output so that the write wait of the graphic data GD1 of the next frame in the frame memory 14 does not occur.

In short, in the case where the write wait signal WT occurs the predetermined reference number m or more, it is decided that the high-speed rendering is necessary. In this case, the write wait OFF flag WTOFF is set into the high state thereby to make it possible to prevent the production of the write wait. On the other hand, in the case where the number of productions of the write wait signal WT is at the predetermined reference number m or less, it is decided that the high-speed rendering is not necessary, and the write wait OFF flag WTOFF is set into the low state, and the write of the graphic data from the image writing unit 1 is caused to suitably wait.

The remaining configurations are similar to those of the first embodiment, so that their description is omitted.

<Actions>

Figure 6:
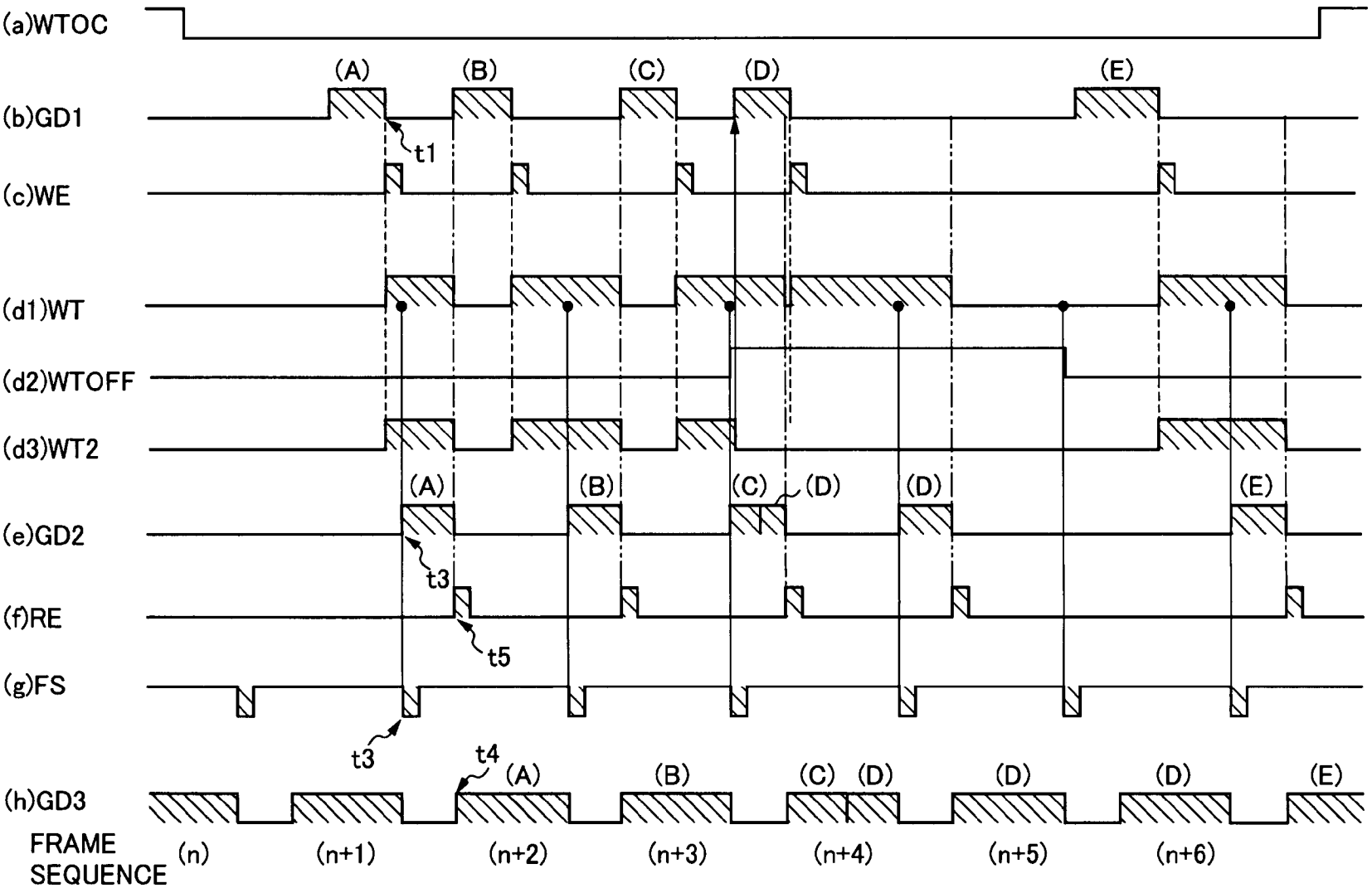
FIG. 6 is a timing chart illustrating the actions of the matrix type display device according to Embodiment 2 of this invention.

The actions of the matrix type display device thus configured are explained with reference to the timing chart of FIG. 6. Here, FIG. 6(*a*) to FIG. 6(*c*) and FIG. 6(*e*) to FIG. 6(*h*) correspond to FIGS. 2(*a*) to 2(*c*) and FIG. 2(*e*) to FIG. 2(*h*), respectively. Moreover, FIG. 6(*d*1) illustrates the write wait signal WT to be produced in the write wait signal output control circuit 23 of the data write control unit 22; FIG. 6(*d*2) illustrates the write wait OFF flag WTOFF to be set in the write wait signal output control circuit 23; and FIG. 3(*d*3) illustrates the second write wait signal WT2 to be produced on the basis of the write wait signal WT and the write wait OFF flag WTOFF and fed to the image writing unit 1.

As described above, the write wait signal output control circuit 23 always decides the number of productions of the write wait signal WT (of FIG. 6(*d*1)) at a timing synchronized with the frame synchronizing signal FS (of FIG. 6(*g*)). In the case where it is decided that the number of productions of the write wait signal WT is at the predetermined reference number of more, it is decided that the write frequency of the graphic data GD1 is higher than the predetermined reference, and the write wait OFF flag WTOFF is set into the high state. On the other hand, in the case where the number of productions of the write wait signal WT is at the predetermined reference number m or less, it is decided that the write frequency is lower than the predetermined reference number, and the write wait OFF flag WTOFF is set into the low state.

Here, the reference number m is set into the optimum value according to the kind of application.

At first, here is described the case, in which the write wait OFF flag WTOFF is in the low state, that is, in the case where the number of productions of the write wait signal WT (of FIG. 6(*d*1)) is at the predetermined reference number or less.

The image writing unit 1 writes the graphic data GD1 (of FIG. 6(*b*)) in the frame memory 14 at the timing of the first frame image data (A) in FIG. 6. When the write ends, the data write control unit 22 outputs the write end signal WE (of FIG. 6(*c*)) at the timing t1 to the synchronizing circuit 17. At this same time, the write wait signal output control circuit 23 in the data write control unit 22 produces the write wait signal WT for instructing the image writing unit 1 not to write the next graphic data in the frame memory 14.

In the case where the write wait OFF flag WTOFF (of FIG. 6(*d*2)) set in the write wait signal output control circuit 23 is in the low state at this instant, the write wait signal WT (of FIG. 6(*d*1)) at the high output is outputted as the second write wait signal WT2 (of FIG. 6(*d*3)) in the high output to the image writing unit 1.

Next, at the timing t3 of the read start signal RK outputted on the basis of the frame synchronizing signal FS (of FIG. 6(*g*)) fed from the signal electrode drive circuit 20, the data read control unit 16 begins to read the image stored in the frame memory 14, as the graphic data GD2 (of FIG. 6(*e*)), and transfers the graphic data GD2 to the display panel module unit 13. The processing in the display panel module unit 13 at this time is similar to the aforementioned one of Embodiment 1 so that its description is omitted.

Subsequently, at the timing t5 when the read of the graphic data GD2 (of FIG. 6(*e*)) ends, the data read control unit 16 outputs the read end signal RE (of FIG. 6(*f*)) in the high state to the data write control unit 22.

At the instant when the read end signal RE (of FIG. 6(*f*)) or the high output is inputted, the data write control unit 22 changes the write wait signal WT (of FIG. 6(*d*1)) to the low output, and feeds it as the second write wait signal WT2 (of FIG. 6(*d*3)) to the image writing unit 1. In response to the change of the second write wait signal WT2 (of FIG. 6(*d*3)) into the low output, the graphic data GD1 (of FIG. 6(*b*)) of the next frame (B) can be written in the frame memory 14 by the image writing unit 1.

Here is described the case, in which the write of the graphic data from the image writing unit 1 is detected at the predetermined reference number m or more so that the write wait OFF flag WTOFF is changed into the high state. In the case where the interval to write the first frame (A), the second frame (B) and the third frame (C) of the graphic data GD1 in the frame memory 14 is short, as shown in FIG. 6(*b*), the write wait signal WT is outputted at the high level at a short interval, as shown in FIG. 6(*d*1).

In the case where the write wait signal WT thus occurs at a short interval so that the number of its productions for a predetermined period based on the frame synchronizing signal FS (of FIG. 6(*h*)) is the reference number m or more, the write wait signal output control circuit 23 changes the write wait OFF flag WTOFF (of FIG. 6(*d*2)) into the high state.

In the case where the write wait OFF flag WTOFF (of FIG. 6(*d*2)) is in the high state, the write wait signal output control circuit 23 outputs the second write wait signal WT2 (of FIG. 6(*d*3)) at the low level to the image writing unit 1 no matter whether the write wait signal WT (of FIG. 6(*d*1)) might be the high output or the low output. When the second write wait signal WT2 (of FIG. 6(*d*3)) in the state keeping the low output, the image writing unit 1 writes the graphic data GD1 (of FIG. 6(*b*)) of a next frame (D) in the frame memory 14 irrespective of the period of the frame synchronizing signal FS (of FIG. 6(*g*)). As a result, there occurs no write wait for the graphic data GD1 (of FIG. 6(*a*)) of the next frame (D) in the frame memory 14.

After this, the write wait signal output control circuit 23 detects the low output of the write wait signal WT on the basis of the frame synchronizing signal FS (of FIG. 6(*g*)). Then, the write wait signal output control circuit 23 changes the write wait OFF flag WTOFF (of FIG. 6(*d*2)) into the low state. The write wait signal WT (of FIG. 6(*c*)), which is produced by writing the graphic data GD1 (of FIG. 6(*a*)) given from the image writing unit 1 in the frame memory 14 at the timing of a fifth frame (E), is outputted as the second write wait signal WT2 (of FIG. 6(*e*)) from the write wait signal output control circuit 23 to the image writing unit 1. In the case where the write wait OFF flag WTOFF (of FIG. 6(*d*)) is thus in the low state, it can be decided that the image writing unit 1 does not need such a high-speed rendering.

In the case where the write number of the graphic data GD1 from the image writing unit 1 into the frame memory 14 for the predetermined period is thus larger than the predetermined reference number, it is decided that the high-speed rendering is necessary, and the write wait OFF flag WTOFF is changed into the high state. In the case where the write wait OFF flag WTOFF is in the high state, the second write wait signal WT2 is outputted at the low level to the image writing unit 1 even if the write wait signal WT is outputted at the high level, but the write of the graphic data from the image writing unit 1 is not inhibited. As a result, the write wait of the graphic data does not occur.

On the other hand, in the case where the write number of the graphic data GD1 from the image writing unit 1 in the frame memory 14 for the predetermined period is less than the predetermined reference number, it is decided that the high-speed render is not necessary, and the write wait OFF flag WTOFF is changed into the low state. In the case where the write wait OFF flag WTOFF is in the low state, the output of the write wait signal WT is outputted as it is as the second write wait signal WT2 to the image writing unit 1. This image writing unit 1 causes the graphic data write to wait suitably, if necessary.

Thus, the write wait signal output control circuit 23 in the data write control unit 22 detects the image write frequency of the image writing unit 1. In the case where the write wait signal output control circuit 23 decides that the image writing unit 1 needs the high-speed rendering, the write wait signal output control circuit 23 feeds the second write wait signal WT2 at the low output to the image writing unit 1 on the basis of the write wait signal WT and the write wait OFF flag WTOFF. As a result, the image writing unit 1 can write the graphic data GD1 in the frame memory 14 without any write wait.

THIRD EMBODIMENT

The matrix type display device of the second embodiment thus far described is configured such that the write wait signal output control circuit 23 of the data write control unit 22 controls whether or not the second write wait signal WT2 is to be outputted according to the state of the write wait OFF flag WTOFF so that the write of the graphic data from the image writing unit 1 in the frame memory 14 is awaited by the second write wait signal WT2 thereby to prevent the execution speed of the application from being lowered. This embodiment is configured such that both the write wait signal WT and the write wait OFF flag WTOFF are outputted to the image writing unit 1 so that whether or not the graphic data GD1 of a new frame are to be written is decided by the image writing unit 1 according to the combination of the two.

<Configuration>

Figure 7:
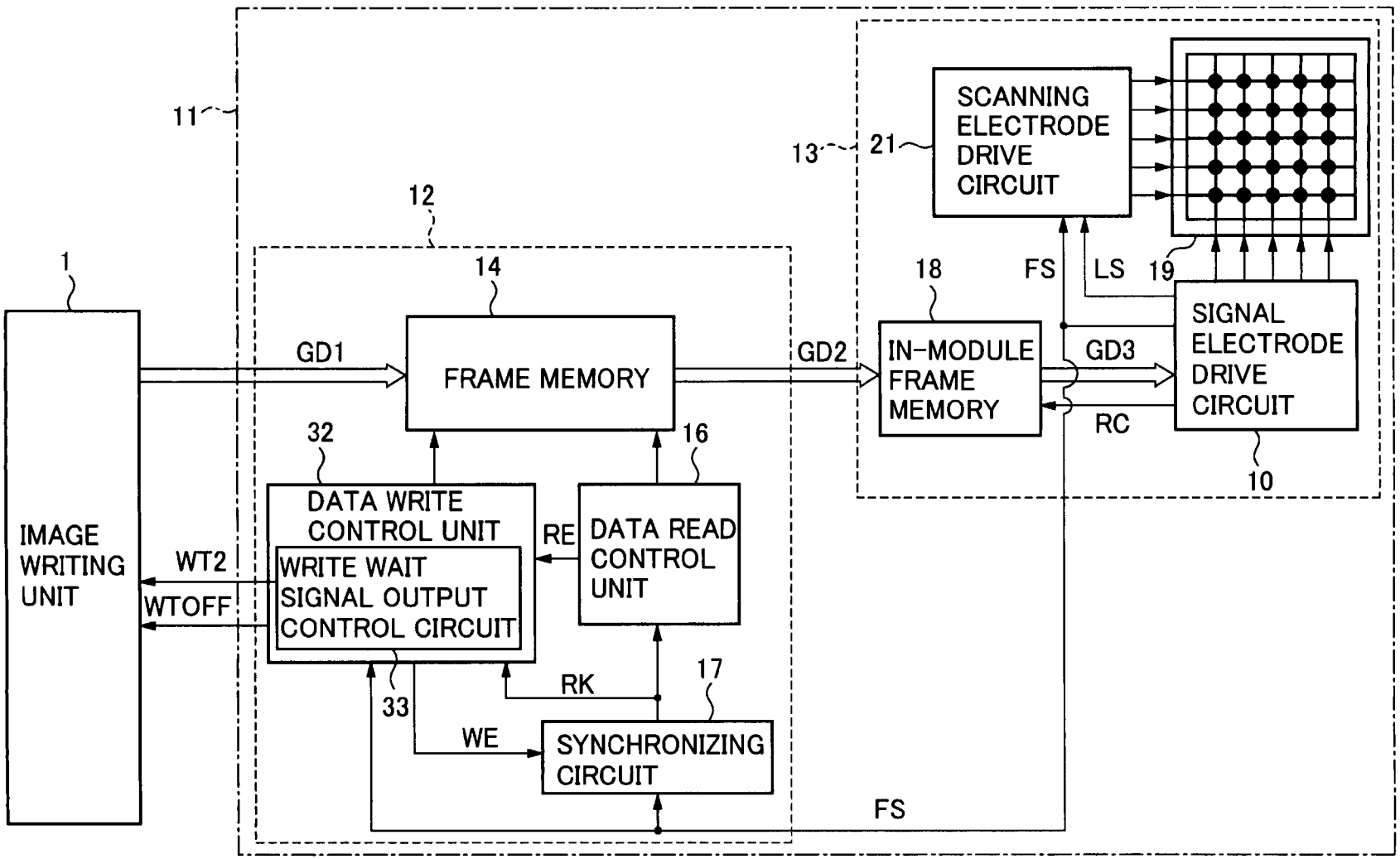
FIG. 7 is a block diagram showing a matrix type display device according to Embodiment 3 of this invention.

FIG. 7 is a block diagram showing a matrix type display device according to the third embodiment of this invention. Here in FIG. 7, the components having functions similar to those of the first embodiment and the second embodiment are designated by the common reference numerals.

<Actions>

To the image writing unit 1, there are inputted both the write wait signal WT from a data write control unit 32 and a write wait OFF signal (i.e., the "write wait OFF flag" in the second embodiment) WTOFF. When the write wait OFF signal WTOFF is the low output, the write wait signal WT is processed as valid, and whether or not the graphic data GD1 are to be outputted is decided based on the write wait signal WT. When the write wait signal WT is the high output, the write of the graphic data GD1 of a next frame in the frame memory 14 is awaited. When the write wait signal WT is at the low output, the write of the graphic data GD1 of the next frame in the frame memory 14 is started.

On the other hand, when the write wait OFF signal WTOFF is at the high output, the graphic data GD1 of the next frame are written in the frame memory 14 not only in the case where the write wait signal WT inputted is the low output but also in the case where the write wait signal WT is at the high output.

Here, the write wait OFF signal WTOFF is fed from a write wait signal output control circuit 33 to the image writing unit 1. Like the write wait signal output control circuit 23 of the second embodiment, the write wait signal output control circuit 33 detects the write frequency of the graphic data GD1 to the frame synchronizing signal FS, and controls whether or not the image write in the frame 14 is permitted.

In the matrix type display device of the configuration shown in FIG. 7, the image writing unit 1 decides whether or not the graphic data GD1 are to be written in the frame memory 14 on the basis of the states of the write wait OFF signal WTOFF and the write wait signal WT. Therefore, the write can be awaited in the case where the high-speed rendering is not necessary, but the graphic data can be written in the case where the high-speed rendering is necessary.

FOURTH EMBODIMENT

Figure 8:
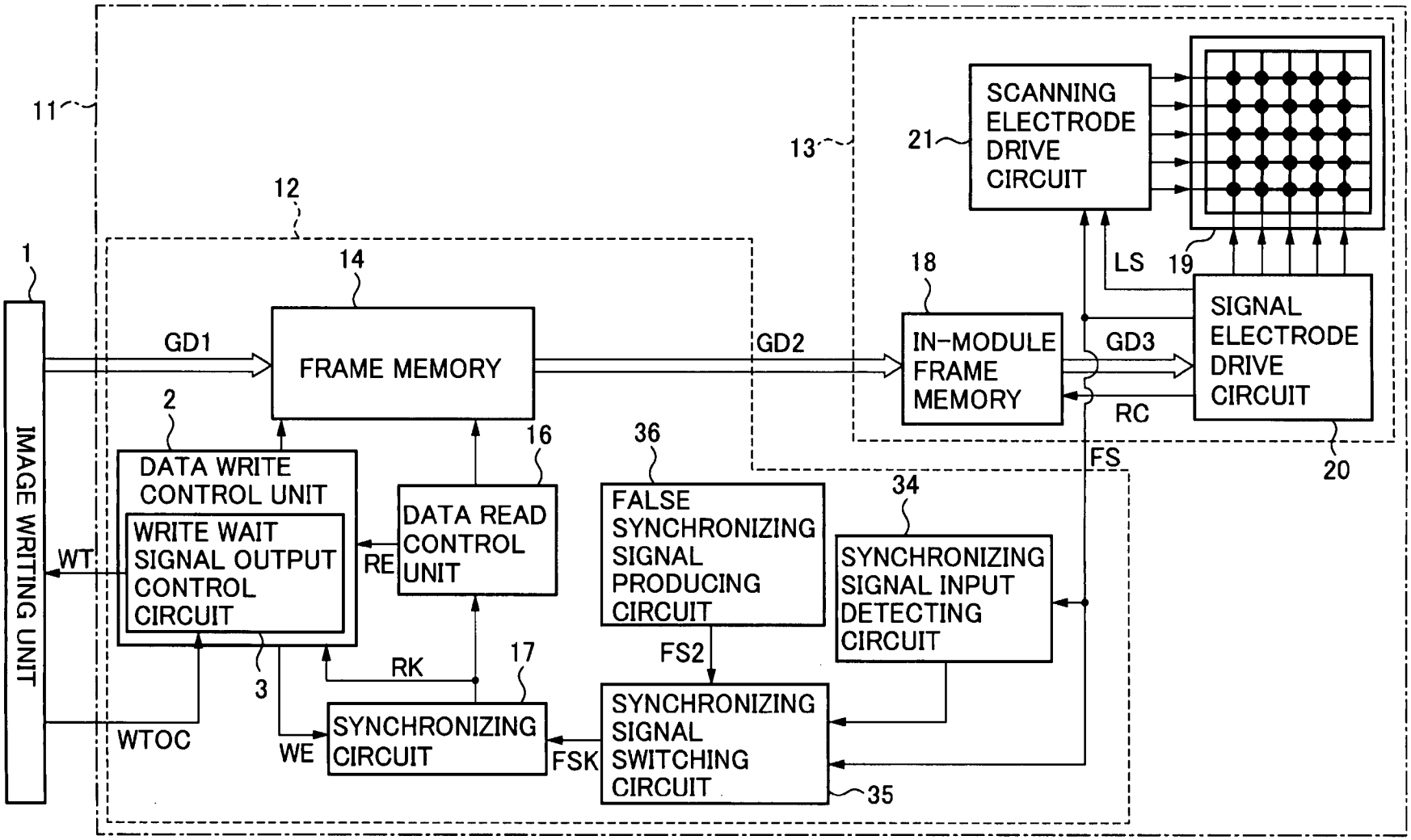
FIG. 8 is a block diagram showing a matrix type display device according to Embodiment 4 of this invention.

FIG. 8 is a block diagram showing a matrix type display device according to the fourth embodiment of this invention. Here in FIG. 8, the components having functions similar to those of the first to third embodiments are designated by the common reference numerals.

<Configuration>

At first, here are described the points, at which the matrix type display device of this embodiment is different from that of the aforementioned first embodiment. This matrix type display device is configured, as shown in FIG. 8, such that the frame synchronizing signal FS outputted from the signal electrode drive circuit 20 is inputted to a synchronizing signal input detecting circuit 34 and a synchronizing signal switching circuit 35.

The synchronizing signal input detecting circuit 34 detects whether or not the frame synchronizing signal FS is inputted, and outputs the detected result as a synchronizing signal detection result signal FSD to the synchronizing signal switching circuit 35.

On the other hand, the input control unit 11 is provided with a false synchronizing signal producing circuit 36 for generating a false synchronizing signal FS2, which can be used in place of the frame synchronizing signal FS. The false synchronizing signal FS2 is inputted to the synchronizing signal switching circuit 35.

To the synchronizing signal switching circuit 35, there are inputted the false synchronizing signal FS which is outputted from the display panel module unit 13, the false synchronizing signal FS2 which is outputted from the false synchronizing signal producing circuit 36, and the synchronizing signal input detecting signal FSD which is outputted from the synchronizing signal input detecting circuit 34. On the basis of the synchronizing signal input detecting signal FSD of the synchronizing signal switching circuit 35, moreover, either the frame synchronizing signal FS or the false synchronizing signal FS2 is selected and outputted as a switched synchronizing signal FSK to the synchronizing circuit 17.

The remaining configurations are similar to those of the first embodiment so that their description is omitted.

<Actions>

Here are described the actions of the matrix type display device thus configured. The processing in the display panel module unit 13 is similar to that of Embodiment 1 so that its description is omitted.

At first, here is described the case, in which the frame synchronizing signal FS is inputted from the display panel module unit 13 to the synchronizing signal input detecting circuit 34 and the synchronizing signal switching circuit 35. When the frame synchronizing signal FS is inputted to the synchronizing signal input detecting unit 34, the synchronizing signal input detecting circuit 34 outputs the synchronizing signal input detecting signal FSD at the low level so as to indicate that the frame synchronizing signal FS is inputted.

The false synchronizing signal generating circuit 36 divides the frequency of the clock owned by the (not-shown) internal circuit of the input control unit 12 or the like, and produces the false synchronizing signal FS2 having a frequency approximate that of the frame synchronizing signal FS. Depending upon the configuration of the input control unit 12, the false synchronizing signal FS2 need not have a frequency approximate that of the frame synchronizing signal FS but may be a signal having a higher frequency than that of the frame synchronizing signal FS. The false synchronizing signal FS2 is outputted from the false synchronizing signal producing circuit 36 and is inputted to the synchronizing signal switching circuit 35.

In the case where the synchronizing signal input detecting signal FSD outputted from the synchronizing signal input detecting circuit 34 is the low output, the frame synchronizing signal FS is being inputted from the display panel module unit 13 to the synchronizing signal switching circuit 35. Therefore, the synchronizing signal switching circuit 35 outputs the frame synchronizing signal FS as the switched synchronizing signal FSK to the synchronizing circuit 17.

In the case where the frame synchronizing signal FS is thus being inputted to the synchronizing signal detecting circuit 34 and the synchronizing signal switching circuit 35, the matrix type display device shown in FIG. 8 can perform actions like those of the device described in connection with Embodiment 1, and can transfer the graphic data GD2 from the input control unit 12 to the display panel module unit 13.

Here is described the case, in which the frame synchronizing signal FS is not inputted from the display panel module unit 13 to the synchronizing signal input detecting circuit 34 and the synchronizing signal switching circuit 35. In the case where the frame synchronizing signal FS is not inputted to the synchronizing signal input detecting circuit 34, this synchronizing signal input detecting circuit 34 sets the synchronizing signal input detecting signal FSD to the high output so as to indicate that the synchronizing signal is not inputted.

In the case where the synchronizing signal input detecting signal FSD outputted from the synchronizing signal input detecting circuit 34 is the high output, the frame synchronizing signal FS is not inputted from the display panel module unit 13 to the synchronizing signal switching circuit 35. Therefore, the synchronizing signal switching circuit 35 outputs the false synchronizing signal FS2 as the switched synchronizing signal FSK to the synchronizing circuit 17.

Here, the remaining configuration components in the input control unit 12 perform the actions like those of Embodiment 1 so that their description is omitted.

With the configuration shown in FIG. 8, even in the case where the frame synchronizing signal FS is not inputted to the input control unit 12, the graphic data GD2 can be transferred from the frame memory 14 to the in-module frame memory 18 in response to the frame synchronizing signal FS2.

Here, the synchronizing signal input detecting circuit 34, the synchronizing signal switching circuit 35 and the false synchronizing signal producing circuit 36 can also be added to the matrix type display device according to the second and third embodiments.

FIFTH EMBODIMENT

Figure 9:
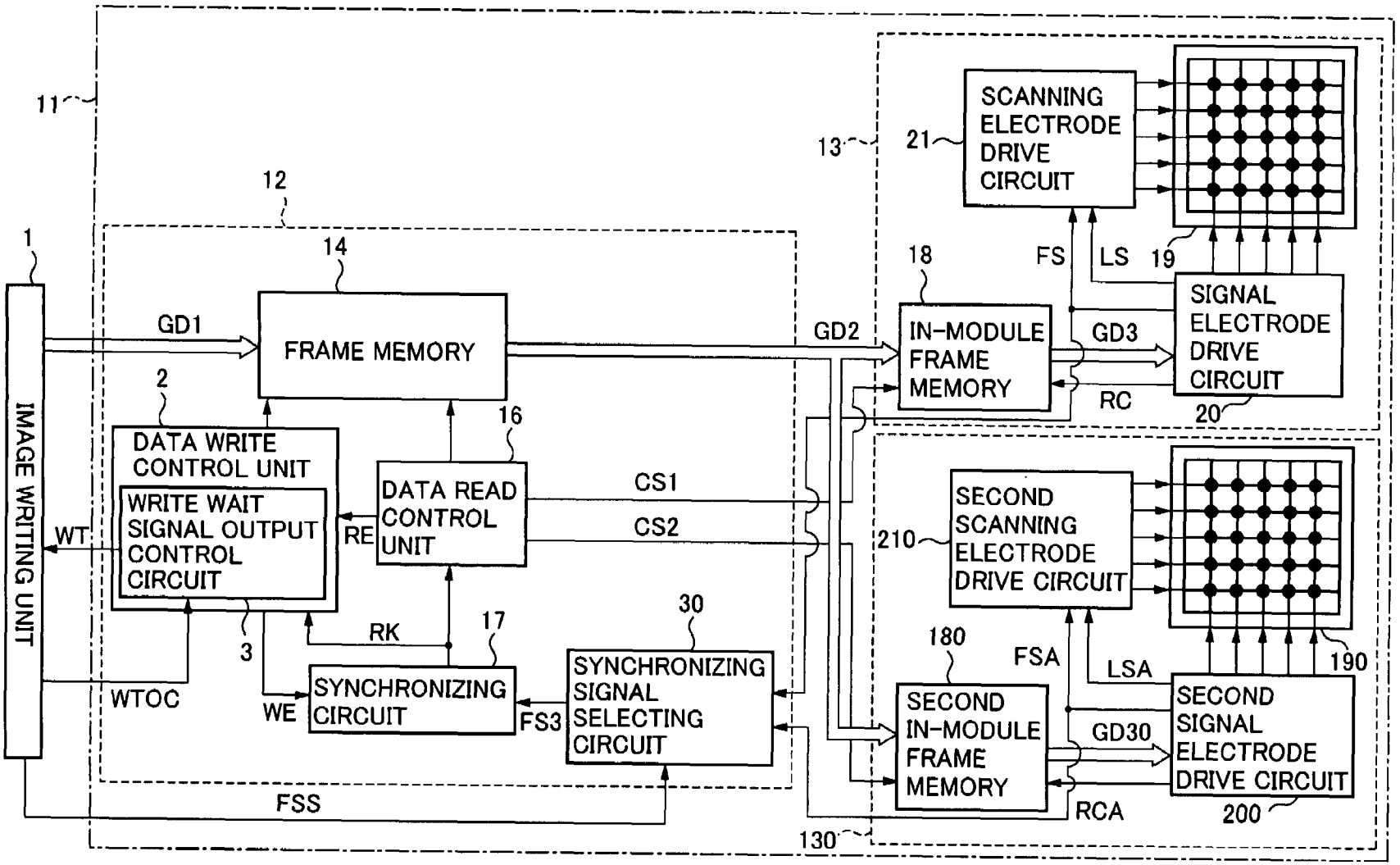
FIG. 9 is a block diagram showing a matrix type display device according to Embodiment 5 of this invention.

FIG. 9 is a block diagram showing a matrix type display device according to a fifth embodiment of this invention. Here, the components having functions similar to those of the first to fourth embodiments are designated by the common reference numerals.

<Configuration>

At first, here is described the points, at which the matrix type display device of the fifth embodiment is different from that of the aforementioned first embodiment. This matrix type display device is provided with not only the display panel module unit 13 but also a second display module 130, as shown in FIG. 9.

Like the display module 13, the second display module 130 is provided therein with a second in-module frame memory 130, a second display panel 190, a second signal electrode drive circuit 200 and a second scanning electrode drive circuit 210. The second signal electrode drive circuit 200 outputs a read control signal RCA to the second in-module frame memory 130, and outputs a line synchronizing signal LSA and a frame synchronizing signal FSA to the second scanning electrode drive circuit 210. Here, the frame synchronizing signal FSA is outputted to a synchronizing signal selecting circuit 30, too.

Moreover, the input control unit 12 is provided with the synchronizing signal selecting circuit 30, to which are inputted the frame synchronizing signal FS from the display panel module unit 13 and the frame synchronizing signal FSA from the second display panel module unit 130. On the basis of a frame synchronization selecting signal FFS from the image writing unit 1, the synchronizing signal selecting circuit 30 selects either the frame synchronizing signal FS or the frame synchronizing signal FSA, and outputs the selected signal as a selected frame synchronizing signal FS3 to the synchronizing circuit 17.

The remaining configurations are similar to those of the first embodiment so that their description is omitted.

<Actions>

Figure 10:
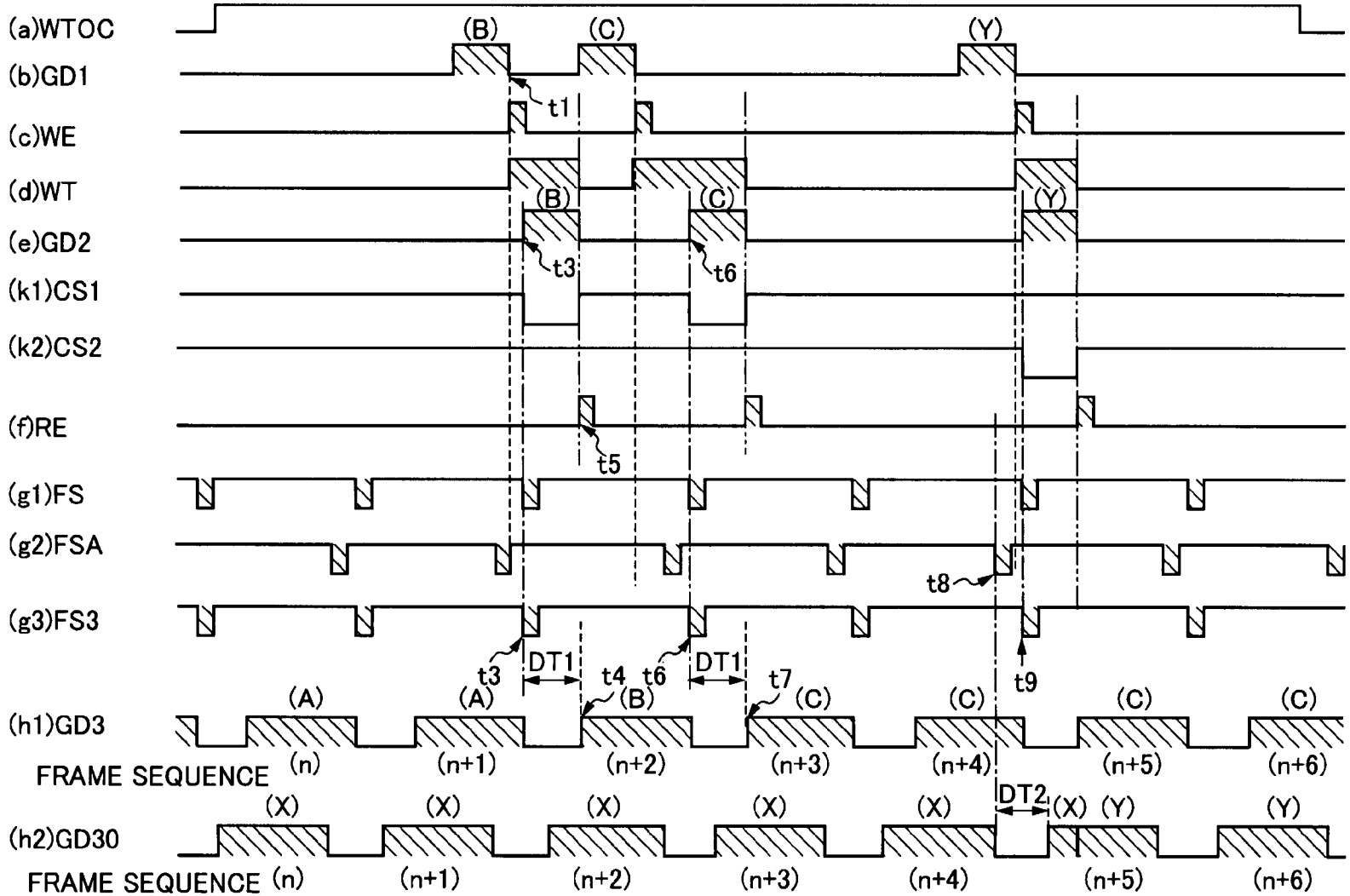
FIG. 10 is a timing chart illustrating the actions of the matrix type display device according to Embodiment 5 of this invention.

The actions of the matrix type display device thus configured are described with reference to a timing chart of FIG. 10. Here, FIG. 10(*a*) to FIGS. 10(*e*) and 10(*f*) correspond to FIG. 2(*a*) to FIGS. 2(*e*) and 2(*f*), respectively. Moreover, FIG. 10(*k*1) illustrates a first selecting signal CS1 to be outputted by the data read control unit 16 to the in-module frame memory 18 in the display panel module unit 13; FIG. 10(*k*2) illustrates a second selecting signal CS2 to be outputted by the data read control unit 16 to the in-module frame memory 180 in the display panel module unit 130; FIG. 10(*g*1) illustrates the frame synchronizing signal FS to be fed from the signal electrode drive circuit 20 to the scanning electrode drive circuit 21 and the synchronizing circuit 17; FIG. 10(*g*1) illustrates the second frame synchronizing signal FS2 to be fed from the signal electrode drive circuit 200 to the scanning electrode drive circuit 210 and the synchronizing circuit 17; FIG. 10(*g*3) illustrates the selected frame synchronizing signal FS3 to be outputted by the synchronizing signal selecting circuit 30 to the synchronizing circuit 17; FIG. 10(*h*1) illustrates the graphic data GD3 to be read from the in-module frame memory 18 and inputted to the signal electrode drive circuit 20; and FIG. 10(*h*2) illustrates graphic data GD30 to be read from the second in-module frame memory 180 and inputted to the second signal electrode drive circuit 200.

The matrix type display device in this embodiment synchronizes the actions of the input control unit 12 with either the frame synchronizing signal FS or the second frame synchronizing signal FS2 selected by the synchronizing signal selecting circuit 30. As a result, the display panel module unit outputting the selected signal may display the image needing no high-speed rendering. In order to permit the write wait signal WT from the write wait signal output control circuit 3, therefore, the image writing unit 1 outputs the high signal as the WT output control signal WTOC, as illustrated in FIG. 10(*a*). In this case, the write wait signal output control circuit 3 decides that the output of the write wait signal WT is permitted, because the WT output control signal WTOC from the image writing unit 1 is the high output. It is assumed that the frame synchronizing signal FS is selected in the synchronizing signal selecting circuit 30.

Moreover, (A) of FIG. 10(*h*1) designates an image written in advance in the in-module memory 18 and displayed in the display panel 19, and (X) of FIG. 10(*h*2) designates an image written in advance in the second in-module memory 180 and displayed in the second display panel 190.

When graphic data (B) for the display module 13 are inputted as the GD1 from the external image writing unit 1 to the input control unit 12 of the matrix type display unit 11, as shown in FIG. 9, the graphic data GD1 are controlled by the data write control unit 2 and are once stored in the frame memory 14.

When the storage of the graphic data GD1 in the frame memory 14 ends at the timing t1, as shown in FIG. 10(*b*), the write end signal WE is outputted at the timing t1 from the data write control unit 2 to the synchronizing circuit 17, as shown in FIG. 10(*c*).

On the other hand, the write wait signal output control circuit 3 of the data write control unit 2 decides that the output of the write wait signal WT is permitted, because the WT output control signal WTOC from the image writing unit 1 is the high output. At the aforementioned timing t1, therefore, the write wait signal output control circuit 3 outputs the write wait signal WT to the image writing unit 1, as shown in FIG. 10(*d*), so that the graphic data (C) of a next frame may not be written in the frame memory 14.

On the basis of the reference signal produced by the not-shown oscillation circuit, the signal electrode drive circuit 20 in the display panel module unit 13 produces and outputs the read control signal RC to the in-module frame memory 18, and outputs the frame synchronizing signal FS (of FIG. 10(*g*1) ) at the timing t3 to the scanning electrode drive circuit 21 and the synchronizing circuit 17. Moreover, the signal electrode drive circuit 20 produces and outputs the line synchronizing signal LS to the scanning electrode drive circuit 21.

On the basis of the reference signal produced by the oscillation circuit different from the oscillation circuit for the signal electrode drive circuit 20, the second signal electrode drive circuit 200 in the second display panel module unit 130 likewise produces and outputs the second read control signal RCA to the second in-module frame memory 18, and outputs the second frame synchronizing signal FSA (of FIG. 10(*g*2)) to the second scanning electrode drive circuit 210 and the synchronizing circuit 17. Moreover, the signal electrode drive circuit 200 produces and outputs the second line synchronizing signal LSA to the scanning electrode drive circuit 21. On the basis of the second frame synchronizing signal FSA and the second line synchronizing signal LSA, the second scanning electrode drive circuit 210 produces and outputs a control signal for the scanning electrodes of the second display panel 190.

On the basis of a frame synchronizing signal selection control signal FSS inputted from the external image writing unit 1, the synchronizing signal selecting circuit 30 is controlled to select the frame synchronizing signal FS (of FIG. 10(*g*1)) outputted from the display module 13. Therefore, the synchronizing signal selecting circuit 30 selects the frame synchronizing signal FS and then outputs it as the frame synchronizing signal FS3 to the synchronizing circuit 17.

The synchronizing circuit 17 is reset, at the instant when fed with the write end signal WE from the data write control unit 2, to transfer to the wait state, in which it waits till the selected frame synchronizing signal FS3 illustrated in FIG. 10(*g*3) is inputted at first.

When the selected frame synchronizing signal FS (of FIG. 10(*g*3)) is inputted to the synchronizing circuit 17, the read start signal RK is outputted to the data read control unit 16 in synchronism with the timing t3 of the input. Then, at this timing t3, the data read control unit 16 reads the graphic data GD1, which are temporarily stored in the frame memory 14, for the display module 13, and outputs the first selecting signal (of FIG. 10(*k*1)) . The data read control unit 16 transfers the read graphic data as the graphic data GD2 (of FIG. 10(*e*)) to the in-module frame memory 18. Specifically in FIG. 10, in synchronism with the output timing t3 of the selected frame synchronizing signal FS3 (of FIG. 10(*g*3)) for reading the (n+2)-th graphic data stored in the in-module frame memory 18, the graphic data GD2 (of FIG. 10(*e*)) is transferred from the frame memory 14 to the in-module frame memory 18 on the basis of the instruction of the data read control unit 16.

Moreover, the graphic data GD3 (of FIG. 10(*h*1)) is outputted from the in-module frame memory 18 to the signal electrode drive circuit 20 at the timing t4, which is delayed by a delay time DT1 from the timing t3 of the selected frame synchronizing signal FS3 (of FIG. 10(*g*3)).

At the instant when the (n+2)-th graphic data stored in the in-module frame memory 18 are to be read as the GD3, therefore, the graphic data (B) newly transferred and stored are read as the GD3 so that they are not switched, while being read, into the graphic data newly transferred midway of one frame.

The graphic data (C) or the next write data are not written in the frame memory 14 for the period from the timing t1 of the write end signal WE of FIG. 10(*c*) to the timing t5, at which the read end signal RE of FIG. 10(*f*) is outputted (that is, while the write wait signal WT is the high output).

When the read end signal RE (of FIG. 10(*f*)) is fed at the timing t5 from the data read control unit 16 to the data write control unit 2, the write wait signal WT (of FIG. 2(*d*)) is changed into the low output. As a result, at the instant of the timing t5, the graphic data (C) (of FIG. 10(*b*)) of the next frame from the image writing unit 1 are written in the frame memory 14.

Here, the graphic data GD2 (of FIG. 10(*e*)) are fed from the input control unit 12 to the display panel module unit 13 in synchronism with the timing t3 of the selected frame synchronizing signal FS3, and the (n+2)-th graphic data GD3 (of FIG. 10(*h*1)) are read in synchronism with the timing t4, which is delayed by the DT1 from the timing t3. The timing t3 of the selected frame synchronizing signal FS3 (of FIG. 10(*g*3)) precedes the timing t4, at which the output of the graphic data GD3 is started, only by the DT1 so that the graphic data GD3 of the (n+1)-th frame of FIG. 10(*h*1) are not switched midway of the frame of the graphic data (B) being transferred.

The transfer of the graphic data (C) of the next frame, which are written in the frame memory 14 at the timing t5, to the in-module frame memory 18 is started at the timing t6 of the next selected frame synchronizing signal FS3, at which the graphic data (B) were read from the in-module frame memory 18.

Thus, in the matrix type display device 11, the graphic data GD2 (of FIG. 10(*e*)) are transferred from the frame memory 14 to the in-module frame memory 18 in synchronism with the selected frame synchronizing signal FS3, i.e., the frame synchronizing signal FS of the display panel 19 in this case. It is, therefore, possible to prevent the transfer of the graphic data GD2 (of FIG. 10(*e*) to the in-module frame memory 18 and the read of the graphic data GD3 (of FIG. 10(*h*1)) from the in-module frame memory 18 to the signal electrode drive circuit 20 from being performed in coincidence with the common address in the in-module frame memory 18. Therefore, the data transfer is controlled to prevent one frame of the image to be displayed in the display panel 19 from being switched in its midway to the image of a next frame. Therefore, when the motion images or graphic images are displayed, the image contents can be prevented from being shifted with time between the upper portion and the lower portion of one frame, so that a smooth image can be displayed.

Here is described the graphic data to be displayed in the second display panel 190. As described above, the signal selected by the synchronizing signal selecting circuit 30 is the frame synchronizing signal FS but not the second frame synchronizing signal FSA. As shown in FIG. 10(*b*) , therefore, the write of the graphic data (Y) in the second in-module frame memory 180 is performed asynchronously of the second frame synchronizing signal FSA so that the image displayed in the second display panel 190 contains time-shifted portions.

Specifically, if the write of the graphic data in the second in-module frame memory 190 from the frame memory 14 is performed asynchronously of the second frame synchronizing signal FSA, the second frame synchronizing signal FSA reads the graphic data (Y) from the frame memory 14 at a timing t8 of FIG. 10(*g*2), and is written in the second in-module frame memory. Then, the graphic data (Y) are displayed as the (n+5)-th data in the second display panel 190 from the second in-module frame memory 180 with a delay of the timing DT2, as shown in FIG. 10(*h*2), as shown in FIG. 10(*h*2).

Since the frame synchronizing signal FS is selected as the selected frame synchronizing signal FS3, however, the graphic data (Y) are read in this case from the frame memory 14 and written in the second in-module frame memory 180. As a result, the graphic data of the (n+5)-th frame to be displayed in the second display panel 190 contain the image, in which the graphic data (X) and the graphic data (Y) are switched in one frame.

In the case where the graphic data of the (n+5)-th frame of FIG. 10(*h*2) are the image, of which the entire frame is updated every frames, such as a camera image, the breaks of the image become remarkable to deteriorate the quality of the image. In the case where the graphic data such as those of the (n+5)-th frame of FIG. 10(*h*2) are the image having a small area to be updated, such as a watch, however, the breaks of the image are not remarkable so that the image deterioration is not serious.

Specifically, the image writing unit 1 outputs the frame synchronizing signal selecting control signal FSS to the synchronizing signal selecting unit 30 so that the synchronizing signal selecting unit 30 may select either the frame synchronizing signal FS from the display panel module unit 13 or the frame synchronizing signal FSA from the display panel module unit 130. At this time, a smooth image can be displayed by selecting the display module unit for displaying the image, the frame of which is entirely or mostly updated, such as the camera image for each frame. On the other hand, the image to be displayed on the other display panel left selected is almost the image needing a partial update such as a graphic image, so that the display of an image having unremarkable breaks and little display deterioration can be realized.

In the description thus far made, moreover, the display module for displaying the image, the frame of which is entirely or mostly updated, such as the camera image is preferred to display a smooth image by selecting either the frame synchronizing signal FS from the display panel module unit 13 or the frame synchronizing signal FSA from the display panel module unit 130 with the synchronizing signal selecting unit 30 in accordance with the kind of the application used. However, in the case where one display module is in the display OFF state or in the power-OFF state, the frame synchronizing signal from the display panel module unit displaying the image may be selected independently of the contents of the other display image so that the display may be made in synchronism with the selected frame synchronizing signal.

As described in connection with the fourth embodiment, moreover, the device may be provided with the synchronizing signal input circuit 34, the synchronizing signal switching circuit 35 and the false synchronizing signal producing circuit 36.

INDUSTRIAL APPLICABILITY

The matrix type display device according to this invention comprises: a frame memory capable of storing at least one frame of graphic data inputted from an image writing unit; a data read control circuit for outputting a write wait signal for causing the write of graphic data to the frame memory to wait, to the image writing unit, and for outputting a write end signal at the time of ending the write of the graphic data inputted from the image writing unit for each frame, in the frame memory; a synchronizing circuit for outputting a read start signal on the basis of the write end signal and a frame synchronizing signal; a data read control circuit for reading the graphic data stored in the frame memory, on the basis of the read start signal; an in-module frame memory for storing the graphic data read from the frame memory; and a display drive circuit for outputting the frame synchronizing signal, reading the graphic data stored in the in-module frame memory and for driving a display panel for displaying the graphic data. As a result, in the case where the application needing the high-speed rendering is started, the rendering is started without any delay of write so that the rendering speed can be prevented from lowering. In the case where the application needing no high-speed rendering is started, on the other hand, the write is delayed so that the contents of the rendered image can be prevented from being shifted with time.

The invention claimed is:

1. A matrix type display device comprising:

a frame memory capable of storing at least one frame of graphic data inputted from an image writing unit;

a data write control circuit for outputting a write wait signal for causing the write of graphic data to said frame memory to wait, to said image writing unit, and for outputting a write end signal at the time of ending the write of the graphic data inputted from said image writing unit for each frame, in said frame memory;

a synchronizing circuit for outputting a read start signal on the basis of said write end signal and a frame synchronizing signal;

a data read control circuit for reading the graphic data stored in said frame memory, on the basis of said read start signal;

an in-module frame memory for storing the graphic data read from said frame memory; and a display drive circuit for outputting said frame synchronizing signal, reading the graphic data stored in said in-module frame memory and for driving a display panel for displaying said graphic data; and wherein said data write control circuit decides it on the basis of the state of the output control signal inputted from said image writing unit whether or not said write wait signal is to be outputted.

2. A matrix type display device as set forth in claim 1 wherein said data read control circuit outputs a read end signal at the read end time for each frame of the graphic data from the frame memory; and said data write control circuit outputs said write wait signal for the period from the write end of a predetermined frame of the graphic data in said frame memory to the read end of said predetermined frame from said frame memory, in the case where the output of the write wait signal is permitted by the output control signal.

3. A matrix type display device as set forth in claim 2 wherein the state of the output control signal is decided by the rendering rate of the graphic data inputted from the image writing unit.

4. A matrix type display device as set forth in claim 1, characterized:

in that the output control signal, for which the output of the write wait signal is not permitted, is inputted to the data write control circuit, in the case where the rendering rate of the graphic data to be inputted from the image writing unit is at the updating rate or higher of the display panel.

5. A matrix type display device as set forth in claim 2, characterized:

in that the state of the output control signal is decided according to the kind of the graphic data to be inputted from the image writing unit.

6. A matrix type display device as set forth in claim 1 comprising:

a synchronizing signal input detecting circuit for detecting the presence/absence of a frame synchronizing signal thereby to output a synchronizing signal input detecting signal based on said detection result;

a false synchronizing signal generating circuit for outputting a false synchronizing signal; and a synchronizing signal switching circuit for selecting either the frame synchronizing signal or the false synchronizing signal on the basis of said synchronizing signal input detecting signal thereby to output the selected one as a switched synchronizing signal; and wherein the synchronizing circuit outputs a read start signal on the basis of said switched synchronizing signal and the write end signal.

7. A matrix type display device as set forth in claim 1, comprising:

a plurality of display panel module units including:

an in-module frame memory;

a display drive circuit; and a display panel for displaying the graphic data read from said in-module frame memory, with said display drive circuit;

wherein a synchronizing signal selecting circuit to be fed with a plurality of frame synchronizing signals from said plural display drive circuit outputs a selected frame synchronizing signal on the basis of one frame synchronizing signal selected by an instruction from the image writing unit; and said synchronizing circuit outputs the read start signal on the basis of said selected frame synchronizing signal and the write end signal.

8. A matrix type display device as set forth in claim 7, characterized in that the synchronizing signal selecting circuit selects the frame synchronizing signal outputted from the display module unit for displaying graphic data having a high updating frequency.

9. A matrix type display device comprising:

a frame memory capable of storing at least one frame of graphic data inputted from an image writing unit;

a data write control circuit for outputting a write end signal at the time of ending the write of the graphic data inputted from said image writing unit for each frame, in said frame memory;

a synchronizing circuit for outputting a read start signal on the basis of said write end signal and a frame synchronizing signal;

a data read control circuit for reading the graphic data stored in said frame memory, on the basis of said read start signal;

an in-module frame memory for storing the graphic data read from said frame memory; and a display drive circuit for outputting said frame synchronizing signal, reading the graphic data stored in said in-module frame memory and driving a display panel for displaying said graphic data; and wherein said data write control circuit outputs the write wait signal for causing the write of the graphic data in said frame memory, and for detecting the frequency of writing the graphic data in said frame memory from said image writing unit with reference to said frame synchronizing signal thereby to output the write wait OFF flag obtained from said detection result, to said image writing unit; and said graphic data write unit controls the output of the graphic data on the basis of said write wait signal and said write wait OFF flag.

10. A matrix type display device as set forth in claim 9, characterized:

in that said data read control circuit outputs a read end signal at the read end time for each frame of the graphic data from the frame memory; and said graphic data write unit delays the output of the graphic data for the period from the write end of a predetermined frame of the graphic data in said frame memory to the read end of said predetermined frame from said frame memory, in the case where the writing frequency is at a predetermined value or less and in the case where the output of the graphic data is permitted by the write wait OFF flag.

11. A matrix type display device as set forth in claim 9 comprising:

a synchronizing signal input detecting circuit for detecting the presence/absence of a frame synchronizing signal thereby to output a synchronizing signal input detecting signal based on said detection result;

a false synchronizing signal generating circuit for outputting a false synchronizing signal; and a synchronizing signal switching circuit for selecting either the frame synchronizing signal or the false synchronizing signal on the basis of said synchronizing signal input detecting signal thereby to output the selected one as a switched synchronizing signal; and wherein the synchronizing circuit outputs a read start signal on the basis of said switched synchronizing signal and the write end signal.

12. A display method for a matrix type display device, comprising:

a first storing step enabling storing of at least one frame of graphic data inputted from an image writing unit;

a data write controlling step of outputting a write wait signal for causing the write of the graphic data at said first step to wait, to said image writing unit, and for outputting a write end signal at the time of ending the write of the graphic data inputted from said image writing unit for each frame, in said frame memory;

a read starting step of outputting a read start signal on the basis of said write end signal and a frame synchronizing signal;

a data reading step of reading the graphic data stored at said first storing step, on the basis of said read start signal;

a second storing step of storing the graphic data read at said data reading step; and a display driving step of outputting said frame synchronizing signal, reading the graphic data stored at said second storing step, and driving a display panel for displaying said graphic data; and wherein said data write controlling step decides it on the basis of the state of the output control signal inputted from said image writing unit whether or not said write wait signal is to be outputted.

13. A display method for a matrix type display device, as set forth in claim 12, characterized:

in that the data reading step outputs the read end signal at the read ending instant for each frame of the graphic data stored at said first storing step; and the data write controlling step outputs said write wait signal for the time period after the write end of the predetermined frame of the graphic data at said first storing step to the read end of said predetermined frame.

* * * * *